US007666055B2

(12) United States Patent
Kim

(10) Patent No.: US 7,666,055 B2
(45) Date of Patent: Feb. 23, 2010

(54) TRAVELING DEVICE FOR MOVING TOYS

(75) Inventor: Kyoung Jin Kim, Seoul (KR)

(73) Assignee: Robomation Co., Ltd, Seoul (KR)

( * ) Notice: Subject to any disclaimer, the term of this patent is extended or adjusted under 35 U.S.C. 154(b) by 802 days.

(21) Appl. No.: 11/358,032

(22) Filed: Feb. 22, 2006

(65) Prior Publication Data

US 2006/0217034 A1 Sep. 28, 2006

(30) Foreign Application Priority Data

Mar. 23, 2005 (KR) ..... 10-2005-0023936

(51) Int. Cl.
*A63H 33/26* (2006.01)

(52) U.S. Cl. ..... 446/136; 446/129; 446/133; 446/468

(58) Field of Classification Search ..... 446/457, 446/468, 466, 129, 136, 133–134; 280/86.757, 280/86.758
See application file for complete search history.

(56) References Cited

U.S. PATENT DOCUMENTS 4,034,504 A * 7/1977 Sudo ..... 446/456
4,471,566 A * 9/1984 Ishimoto ..... 446/129
4,571,213 A * 2/1986 Ishimoto ..... 446/468
4,881,917 A * 11/1989 Suzuki et al. ..... 446/468
5,851,134 A * 12/1998 Chiu ..... 446/468
6,231,422 B1 * 5/2001 Choi ..... 446/444
6,350,173 B1 * 2/2002 Tsang ..... 446/444

* cited by examiner

*Primary Examiner*—Peter DungBa Vo
*Assistant Examiner*—Alex F. R. P. Rada, II
(74) *Attorney, Agent, or Firm*—Birch, Stewart, Kolasch & Birch, LLP

(57) ABSTRACT

Disclosed herein is a traveling device for moving toys. The traveling device includes a base plate formed in a plate shape; first and second magnets fixedly mounted on the base plate to be spaced apart from each other by a predetermined distance and configured to have opposite polarities on the upper surfaces thereof; a coil part mounted to be spaced apart from the first and second magnets, and formed of a wound coil, so that it generates magnetic force having a polarity that repels one of the first and second magnets when electricity is applied thereto; an arm rotatably mounted on the base plate by a hinge, and provided with the coil part at one end thereof and a braking arm at the other end thereof; a traveling arm rotatably mounted on the base plate by the hinge, provided with front wheels at both ends thereof, and configured to come into contact with the braking arm when the braking arm is rotated through a predetermined angle; a control unit configured to perform control such that current is supplied to the coil part in a predetermined pattern; and a power supply unit configured to supply power to the control unit.

14 Claims, 9 Drawing Sheets

【Fig 1】
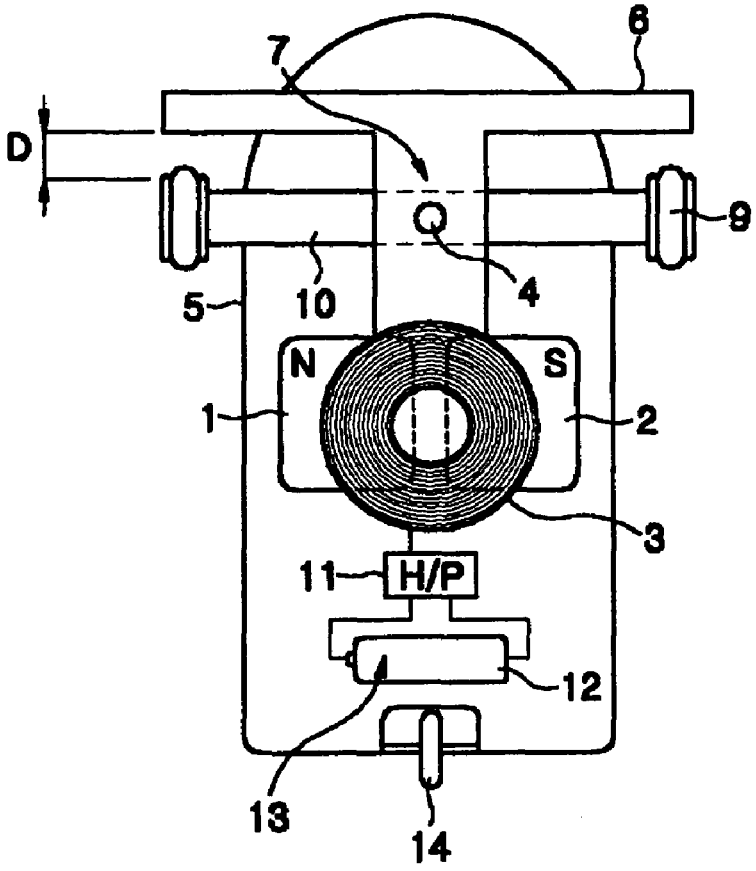
【Fig 2】
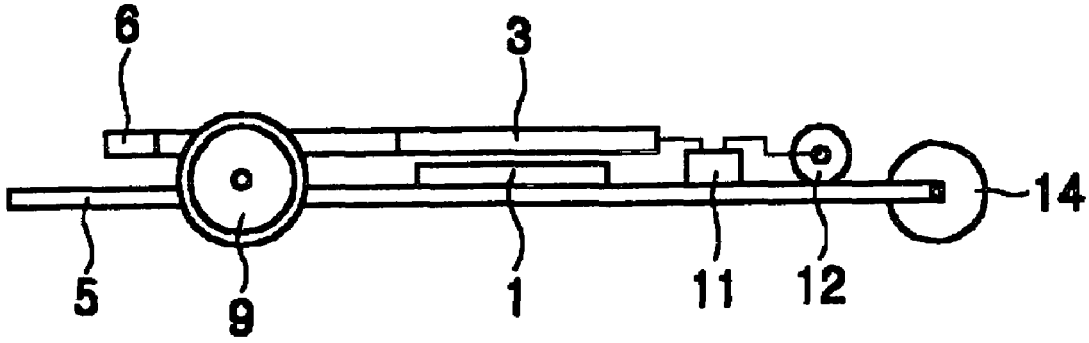

【Fig 3A】
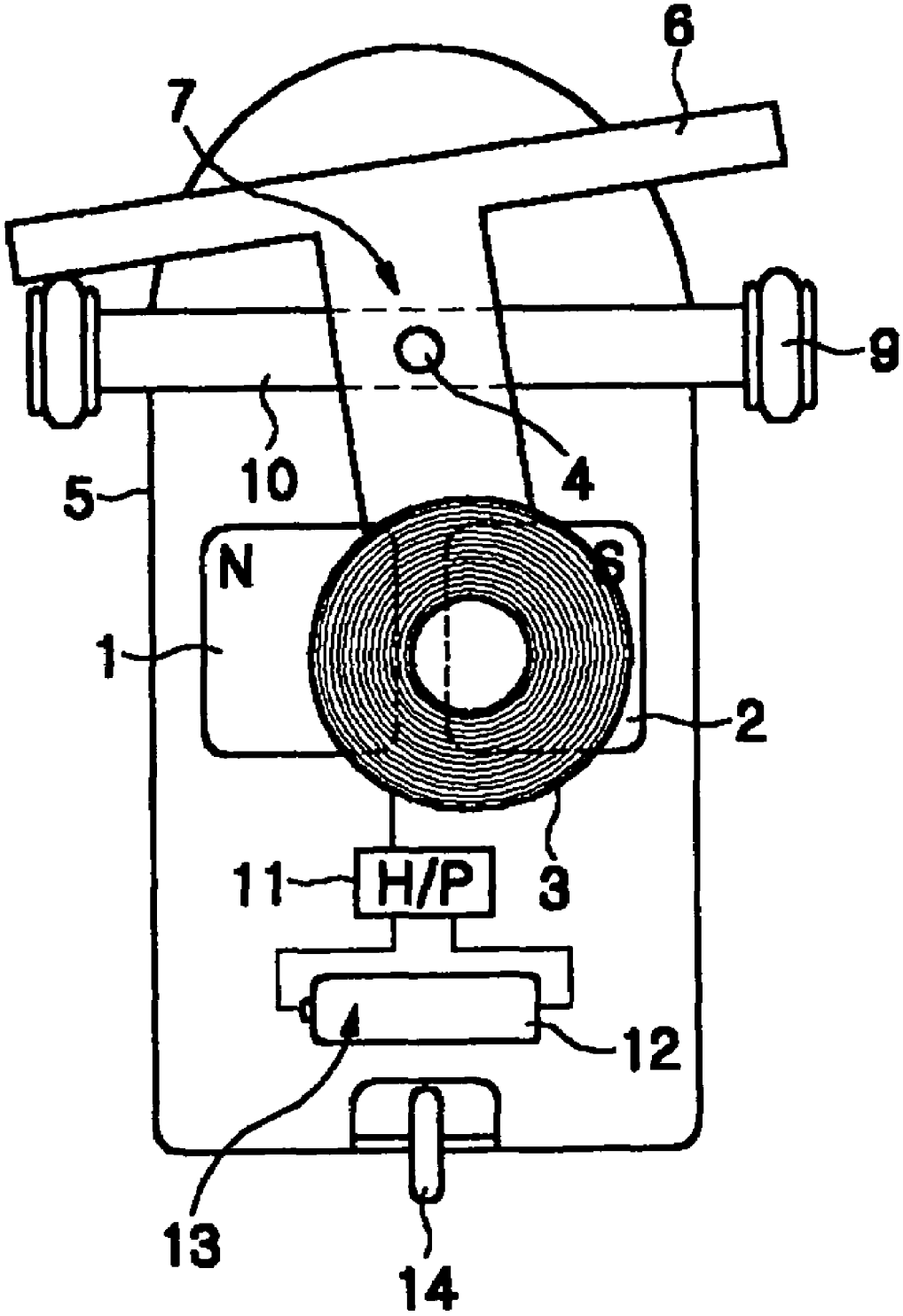

【Fig 3B】
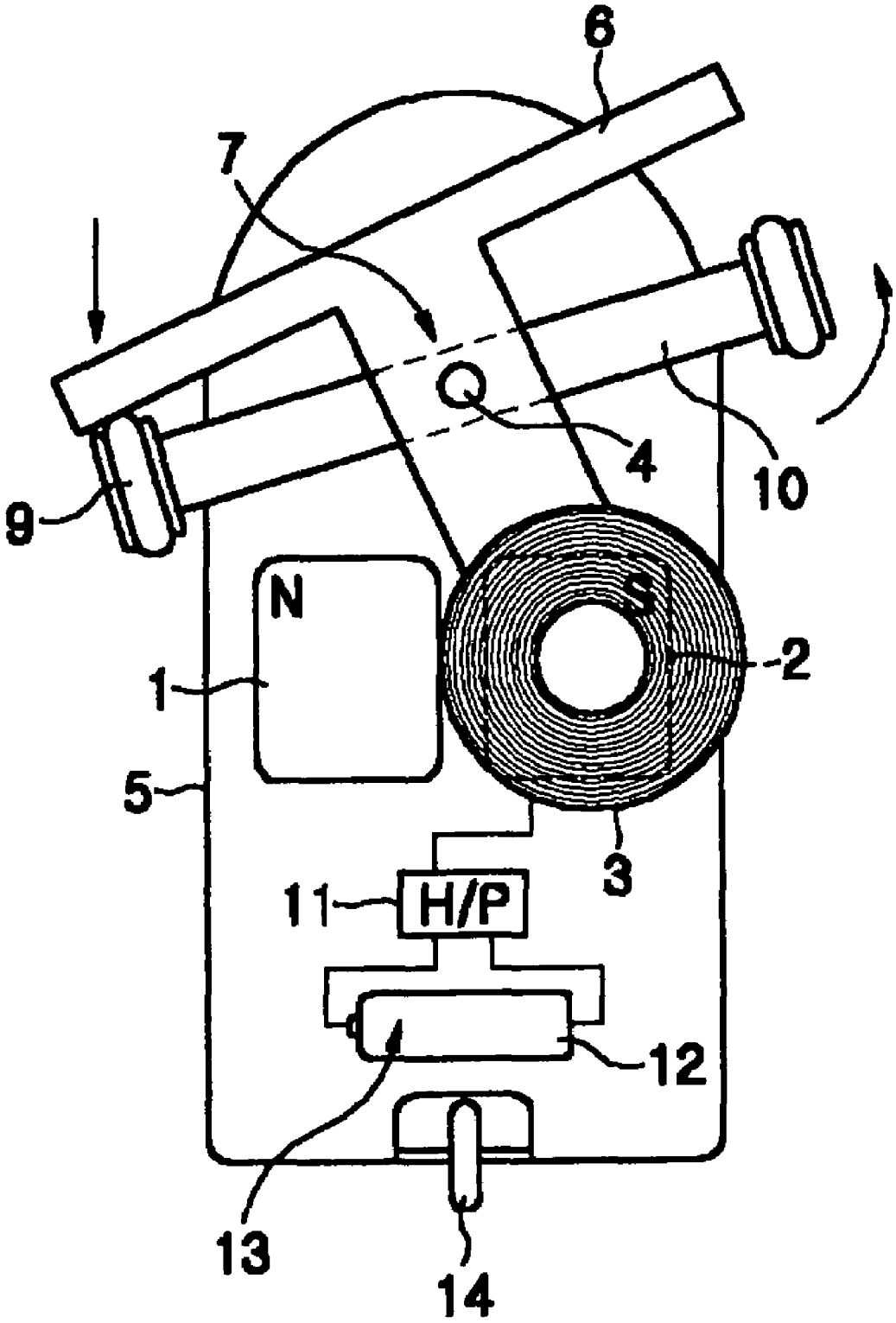

【Fig 3C】
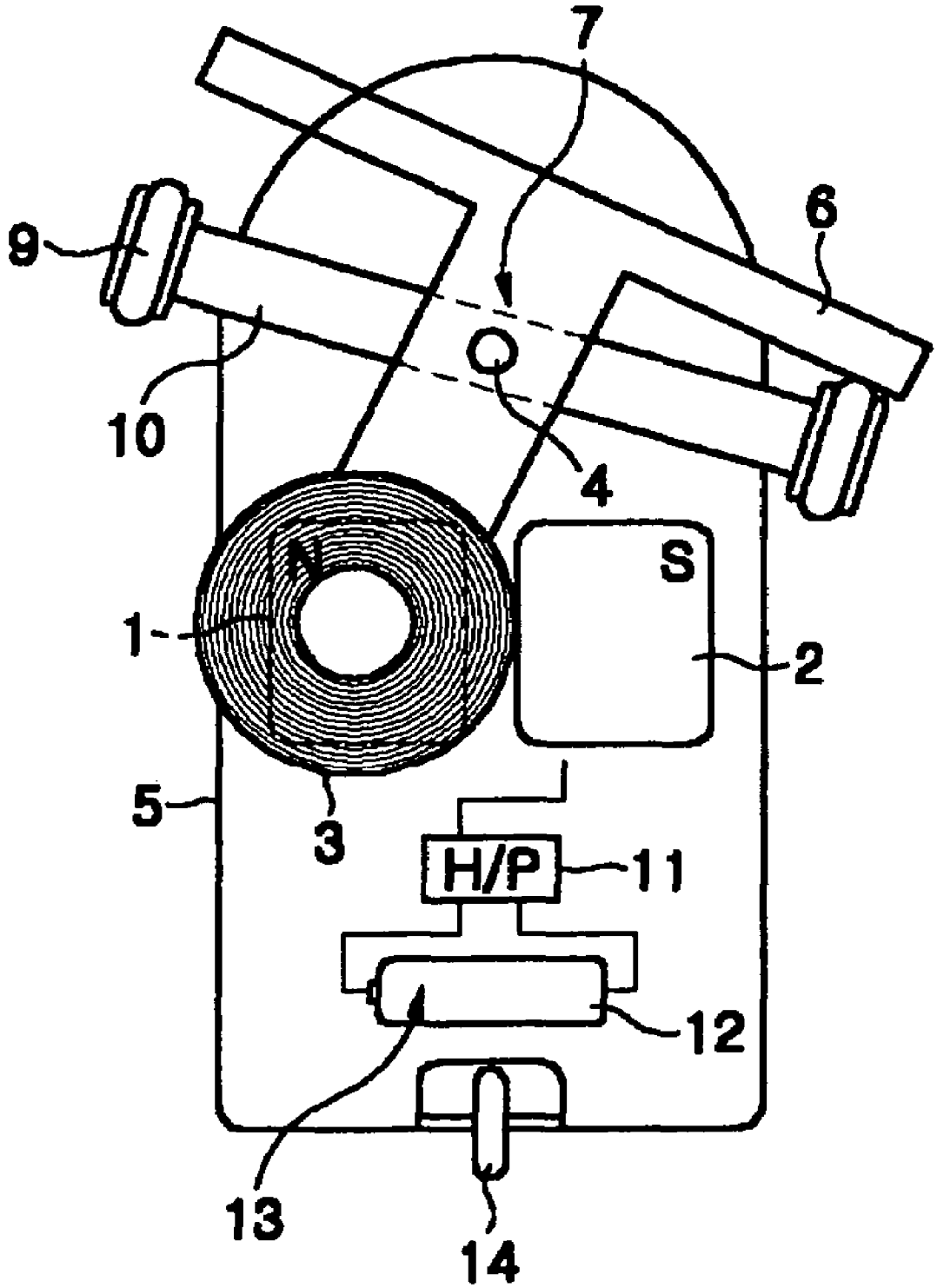

【Fig 4】
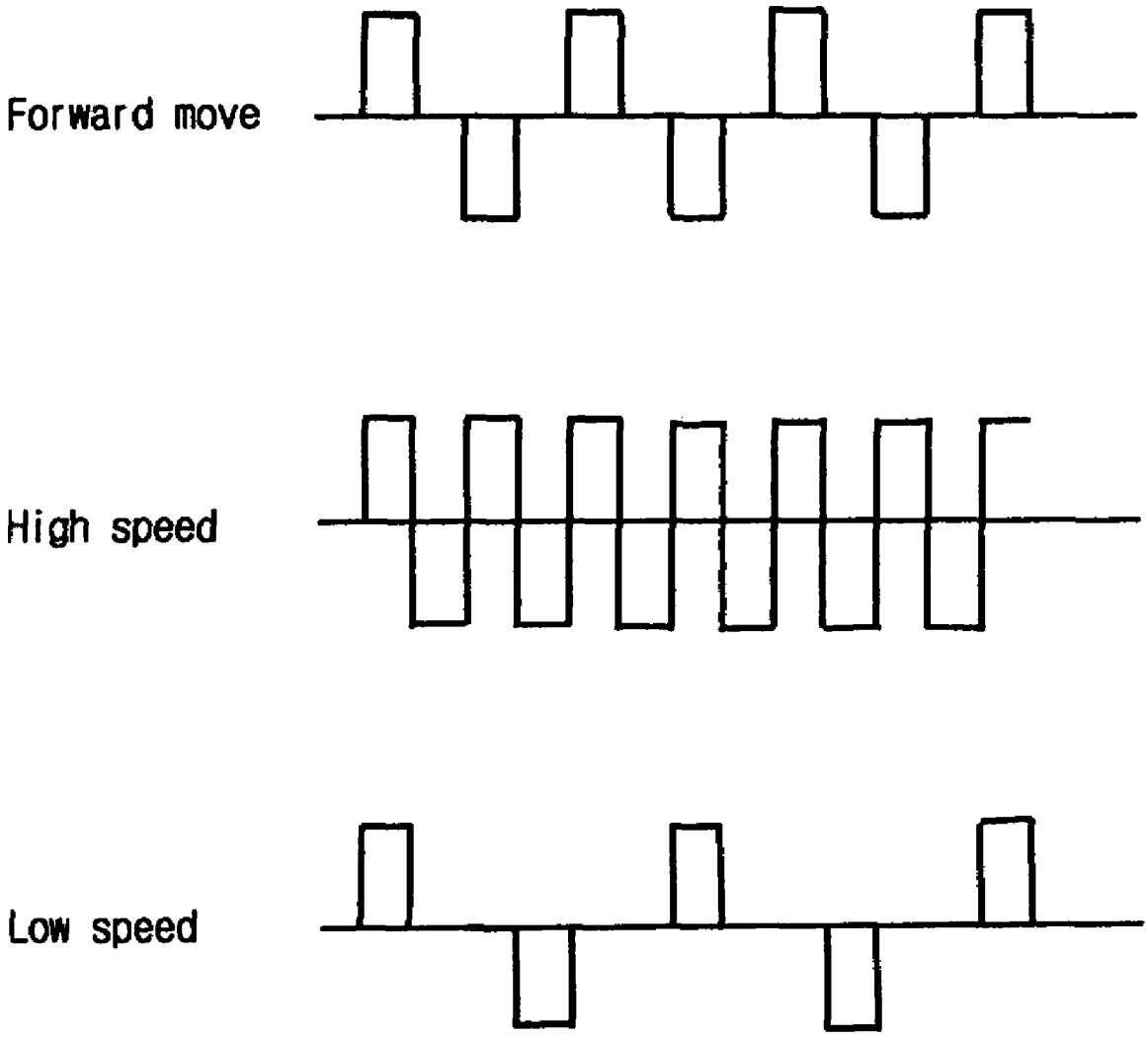

【Fig 5A】
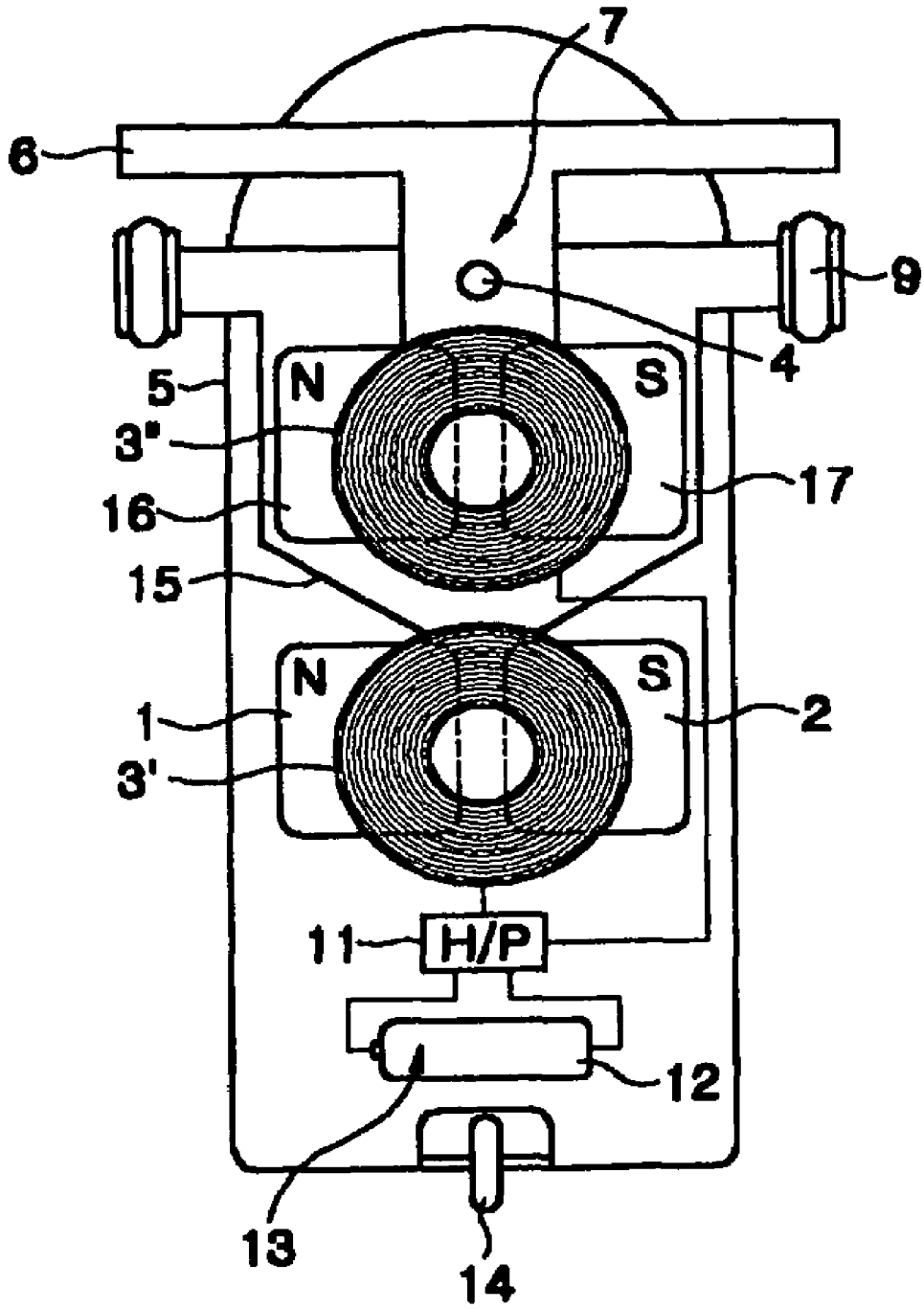

【Fig 5B】
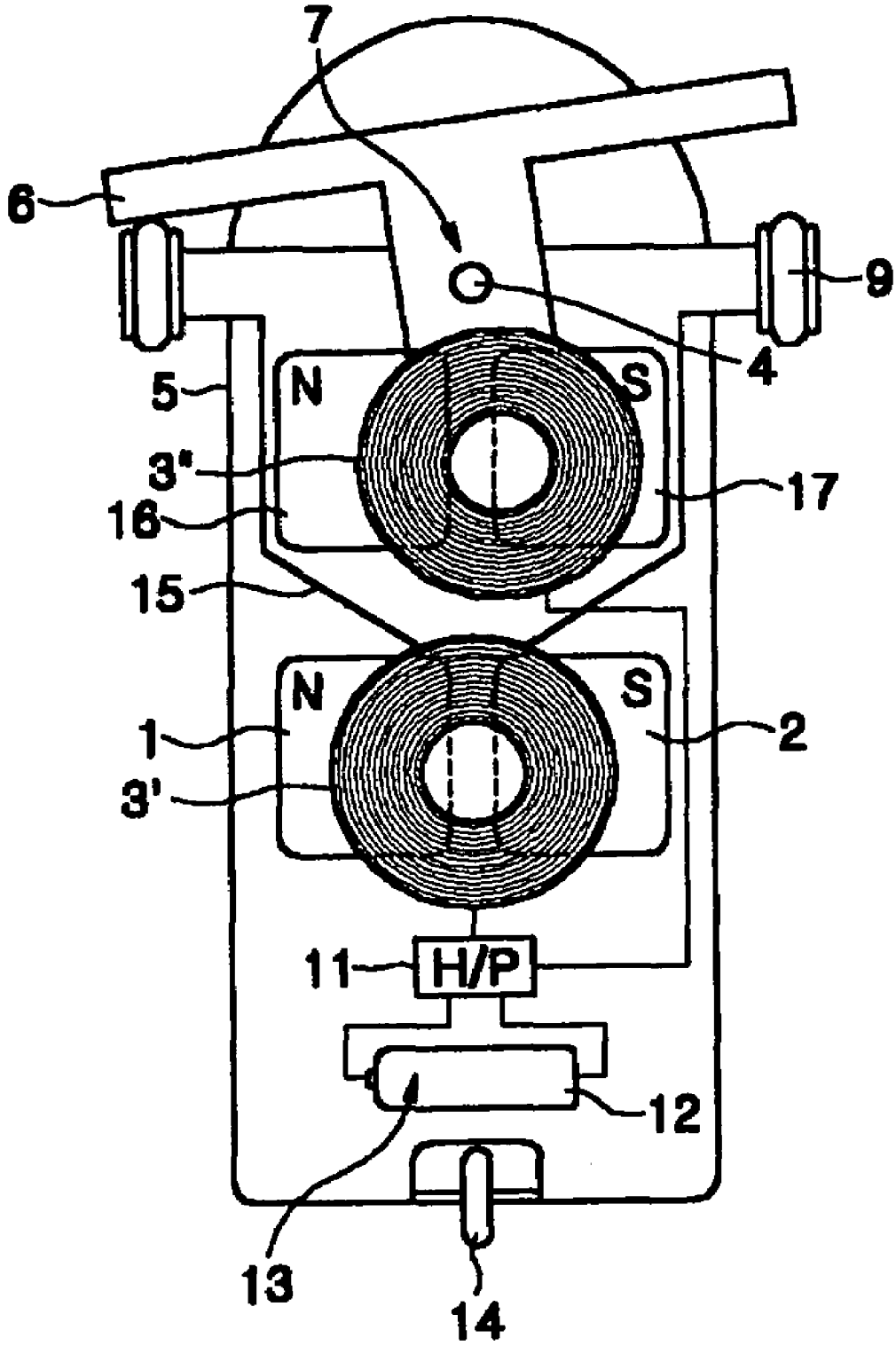

【Fig 5C】
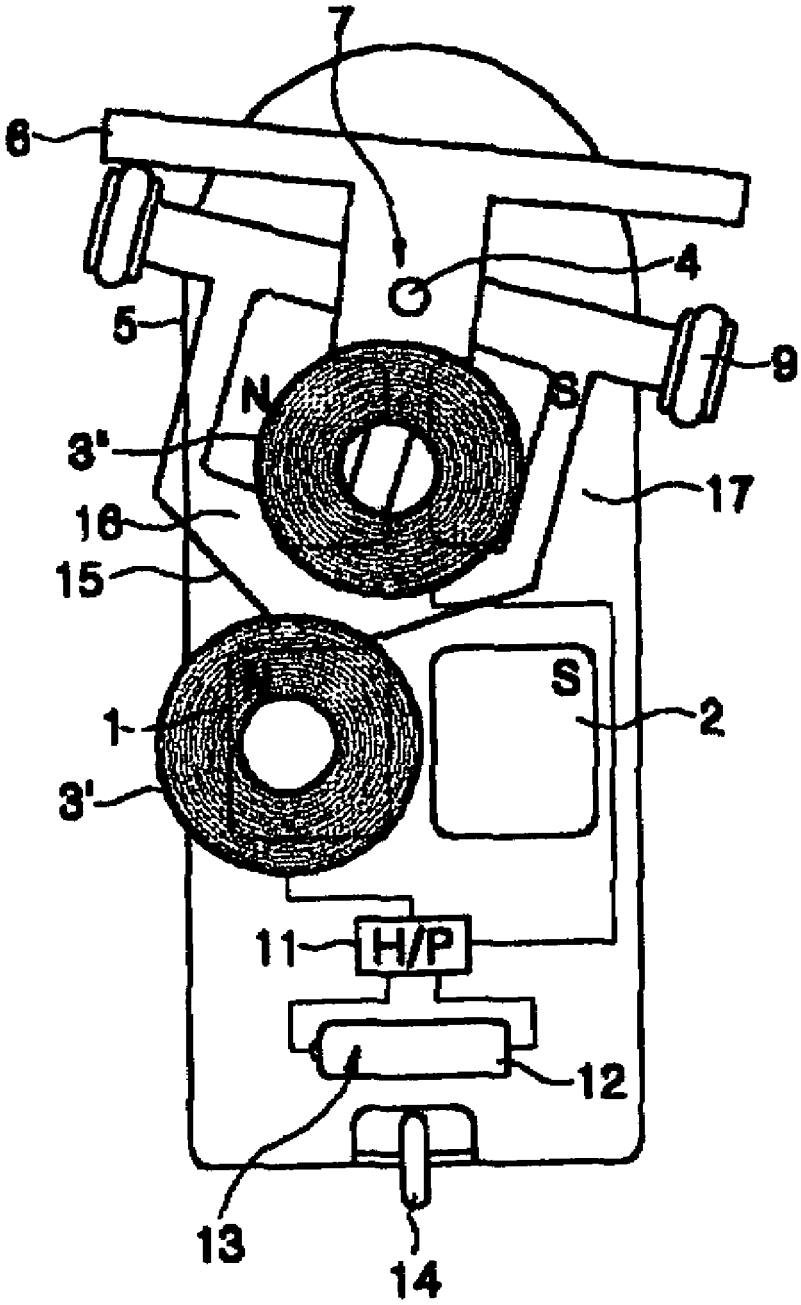

【Fig 6】
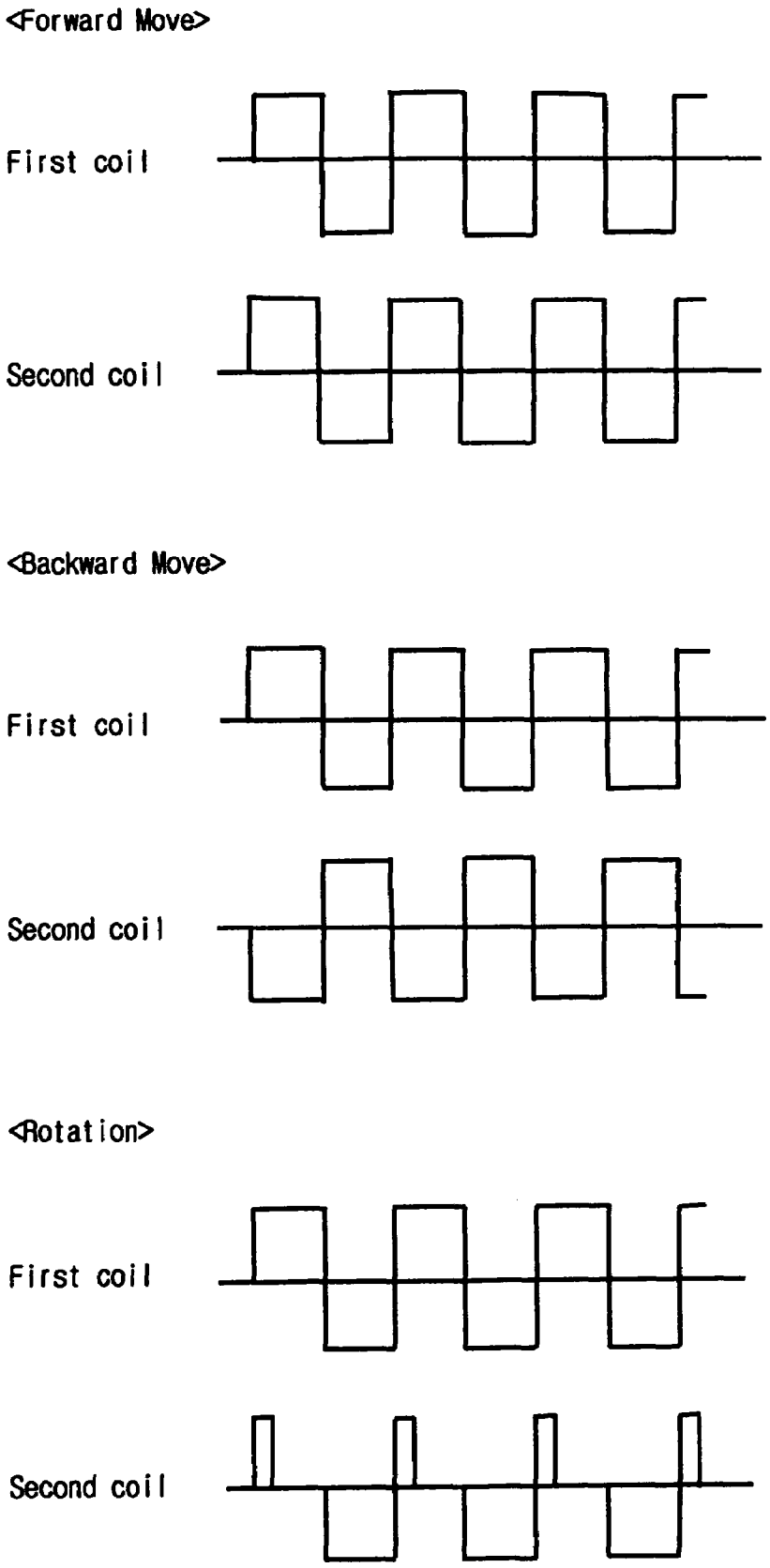

TRAVELING DEVICE FOR MOVING TOYS

BACKGROUND OF THE INVENTION

1. Field of the Invention

The present invention relates generally to a traveling device for moving toys and, more particularly, to a traveling device for moving toys that can implement forward and backward movement and rotation by rotating wheels without using a motor or a reduction gear and minimize the volume of a moving toy.

2. Description of the Related Art

In general, moving toys, such as a Radio Control (R/C) car, are provided with reduction gears for reducing rotating speed generated by motors along with the motors for rotating wheels, so that the rotating speed generated by the motors is reduced by the reduction gears, and the reduced rotating speed is transmitted to the wheels, thus causing the moving toys to travel using high driving force.

That is, in the moving toys equipped with motors, such as cars, not only is rotating speed generated by the motors reduced, but rotating force is also increased, so that the moving toys can be operated using the increased rotation force.

Furthermore, the moving toys, such as cars, are equipped with batteries or rechargeable batteries that supply current to the motors.

However, in the case where such motors and reduction gears are used as parts for generating the driving force of moving toys, the volumes of the moving toys considerably increase due to the volumes of the motors and the reduction gears, so that a problem occurs in that it is impossible to manufacture small and flat moving toys.

In order to solve such a problem, small volume motors (micromotors) and small volume reduction gears may be employed. However, when this approach is used, a problem arises in that the output of the motors is low, and the unit cost of the parts is high, thus increasing the cost of manufacturing the moving toys.

Moreover, since the motors and the reduction gears are parts that generate rotation, a separate addition linking means must be provided so as to implement movement such as the crawling of an insect, so that problems occur in that the sizes of moving toys are increased, the manufacturing cost thereof is increased, and the number of component parts is increased, thus increasing the malfunction rates of the moving toys.

SUMMARY OF THE INVENTION

Accordingly, the present invention has been made keeping in mind the above problems occurring in the prior art, and an object of the present invention is to provide a traveling device for moving toys that can implement the forward and backward movement and rotation of a moving toy without using both a motor and a reduction gear, and which can considerably reduce the volume and height of the moving toy.

In order to accomplish the above object, the present invention provides a traveling device for moving toys, including a base plate formed in a plate shape; first and second magnets fixedly mounted on the base plate to be spaced apart from each other by a predetermined distance and configured to have opposite polarities on the upper surfaces thereof; a coil part mounted to be spaced apart from the first and second magnets, and formed of a wound coil, so that it generates magnetic force having a polarity that repels one of the first and second magnets when electricity is applied thereto; an arm rotatably mounted on the base plate by a hinge, and provided with the coil part at one end thereof and a braking arm at the other end thereof; a traveling arm rotatably mounted on the base plate by the hinge, provided with front wheels at both ends thereof, and configured to come into contact with the braking arm when the braking arm is rotated through a predetermined angle; a control unit configured to perform control such that current is supplied to the coil part in a predetermined pattern; and a power supply unit configured to supply power to the control unit.

BRIEF DESCRIPTION OF THE DRAWINGS

The above and other objects, features and advantages of the present invention will be more clearly understood from the following detailed description taken in conjunction with the accompanying drawings, in which:

FIG. 1 is a plan view illustrating a traveling device for moving toys according to an embodiment of the present invention;

FIG. 2 is a side view of FIG. 1;

FIG. 3A is a plan view illustrating a state in which the braking arm of FIG. 1 comes into contact with one of wheels;

FIG. 3B is a plan view illustrating a state in which the braking arm of FIG. 3A is further rotated and causes the other wheel to rotate;

FIG. 3C is a plan view illustrating a state in which the braking arm of FIG. 3B is rotated in a backward direction and causes the former wheel to rotate;

FIG. 4 is a waveform diagram illustrating the supply of current to the coil of FIG. 1;

FIG. 5A is a plan view illustrating a double-acting traveling device for moving toys according to another embodiment of the present invention;

FIG. 5B is a plan view illustrating a state in which the braking arm of FIG. 5A is caused to come into contact with one wheel by a first coil;

FIG. 5C is a plan view illustrating a state in which backward movement is performed by the second coil of FIG. 5B; and FIG. 6 is a waveform diagram illustrating the supply of current to first and second coils for forward and backward movement and rotation in the double-acting traveling device of FIG. 5A.

DESCRIPTION OF THE PREFERRED EMBODIMENTS

Reference now should be made to the drawings, in which the same reference numerals are used throughout the different drawings to designate the same or similar components.

First, the construction of a traveling device for moving toys according to an embodiment of the present invention is described below with reference to the plan view of FIG. 1 and the side view of FIG. 2.

The traveling device for moving toys according to the present invention includes a base plate 5 formed in a plate shape; first and second magnets 1 and 2 fixedly mounted on the center portion of the base plate 5 to be spaced apart from each other by a predetermined distance and configured to have opposite polarities (N and S poles) on the upper surfaces thereof; a coil part 3 placed adjacent to the first and second magnets to be slightly spaced apart from the upper surfaces of the first and second magnets 1 and 2, and formed of a coil wound a predetermined number of turns so that it generates magnetic force having a specific polarity when current is applied thereto; an arm 7 provided with the coil part 3 at one end thereof, freely rotatably mounted on the base plate 5 by a hinge 4, and provided with a T-shaped braking arm 6 at the other end thereof; a traveling arm 10 freely rotatably mounted on the base plate 5 by the hinge 4, and provided with front wheels 9 at both ends thereof such that one of the front wheels 9 comes into contact with the braking arm 6 when the braking arm 6 is rotated through a predetermined angle; a control unit 11 configured to have a microprocessor that performs control such that current is supplied to the coil part 3 in a predetermined pattern; and a power supply unit 11 configured to include a battery 12 mounted on the base plate 5 to supply power to the control unit 11, and an on/off switch (not shown).

That is, the first and second magnets 1 and 2 having opposite polarities on the upper surfaces thereof are placed adjacent to the coil part 3, so that, when magnetic force having a specific polarity is generated in the coil part 3, the coil part 3 is repelled by one magnet and, thus, the arm 7 is rotated around the hinge 4. As the arm 7 is rotated, the braking arm 6 comes into contact with one front wheel 9. When the braking arm 6 pushes the front wheel further, only the other free front wheel 9 is rotated and moves forward. By repeating the above-described operation for both wheels 9, the base plate 5 can move forward.

Meanwhile, a rear wheel 14 is mounted on the rear portion of the base plate 5, so that the entire base plate 5 can efficiently move when the entire base plate 5 is moved by the front wheels 9.

In that case, as long as one wheel 9 is not in contact with the braking arm 6 when the other wheel 8 is in contact with the braking arm 6, the shorter the distance D between the braking arm 6 and the front wheels 9 is, the better the distance D is. The reason for this is that, during the rotation of the braking arm 6, the braking arm 6 can cause one front wheel 9 to move forward by coming into contact with and then further pushing the other front wheel 9 and, thereby, causing the traveling arm 10 to rotate.

Now, a method of assembling the traveling device for moving toys according to the present invention is described in detail below.

First, a first magnet 1 having an N pole at the upper surface thereof and a second magnet 2 having an S pole at the upper surface thereof are spaced from each other by a predetermined distance, and are fixedly mounted on the center portion of a base plate 5.

After the first and second magnets 1 are 2 have been mounted on the base plate 5, a traveling arm 10 and an arm 7 are freely rotatably mounted on the base plate 5 by a hinge 4, and a coil part 3 is mounted on the upper surface of the portion of the arm 7 adjacent to the first and second magnets 1 and 2.

The coil part 3 has a typical construction that is obtained by winding a coil a predetermined number of turns around a bobbin having a relatively short height.

Furthermore, the coil is electrically connected to the control unit 11 through a wire.

Next, the operation of the traveling device according to the present invention is described below.

When the control unit 11 directs forward current to flow to the coil in the assembled traveling device, magnetic force depending on the direction of the current is generated. For example, assuming that an N-polar magnetic force is generated, the coil part 3 moves toward the second magnet 2 (having an S pole on its upper surface) while repelling the first magnet 1 (having an N pole on its upper surface).

As the coil part 3 moves to the second magnet 2, the arm 7 is rotated around the hinge 4 counterclockwise, as illustrated in FIG. 3A, and the left front wheel 9 and the left portion of the braking arm 6 come into contact with each other and the right front wheel 9 and the right portion of the braking arm 6 become spaced apart from each other.

When the left front wheel 9 and the left portion of the braking arm 6 start to come into contact with each other, the left front wheel 9 starts to be locked by frictional force. In this case, when the left portion of the braking arm 6 further pushes the left front wheel 9, as illustrated in FIG. 3B, and, thus, causes the traveling arm 10 to rotate counterclockwise, only the right front wheel 9 is rotated and moves a specific distance.

That is, since the left front wheel 9 is locked, the right front wheel 9 is rotated and, thus, the entire moving toy moves forward a specific distance.

In this case, when the control unit 11 directs backward current to flow to the coil, an S-polar magnetic force is generated in the coil part 3 and, thus, the coil p art 3 moves toward the first magnet 1, as illustrated in FIG. 3C. The same mechanism is applied to the clockwise rotation of the arm 7 around the hinge 4, so that the left front wheel 9 moves forward.

When the right and left front wheels 9 move forward in a zigzag fashion through the repetition of right and left forward movements, the entire base plate (moving toy) 5 can move forward.

In this case, when the periods which are controlled by the control unit 11 and for which current flows to the coil are the same for forward and backward current (see the first waveform of FIG. 4), the right and left front wheels 9 are rotated and move forward the same distance, resulting in forward movement.

In this case, when the interval between supplied pulses is short under the control of the control unit 11 (see the second waveform of FIG. 4), the fast clockwise and counterclockwise rotations of the arm 7 are performed and, thus, the speed of forward movement is increased. When the interval between supplied pulses is long (see the third waveform of FIG. 4), the speed of forward movement is decreased. Meanwhile, when the pulse width of forward current is different from that of backward current, rotation is performed.

Meanwhile, the above-described single-acting moving toy cannot perform backward movement, but a double-acting moving toy having two coil parts, as illustrated in FIG. 5A, can perform forward and backward movement and rotation.

The double-acting traveling device for moving toys according to the present invention includes a base plate 5 formed in a plate shape; first and second magnets 1 and 2 fixedly mounted on the center portion of the base plate 5 to be spaced apart from each other by a predetermined distance and configured to have opposite polarities (N and S poles) on the upper surfaces thereof; a first coil part 3' mounted to be slightly spaced apart from the upper surfaces of the first and second magnets 1 and 2, and formed of a coil wound a predetermined number of turns so that it generates magnetic force having a specific polarity when current is applied thereto; a rotating plate 15 provided with the coil part 3' at one end thereof, freely rotatably mounted on the base plate 5 by a hinge 4, and provided with front wheels at the other end thereof; third and fourth magnets 16 and 17 fixedly mounted on the rotating plate 15; a second coil part 3" placed adjacent to the third and fourth magnets 16 and 17 to be slightly spaced apart from the upper surfaces of the third and fourth magnets 16 and 17; an arm 7 provided with the coil part 3" at one end thereof, freely rotatably mounted on the base plate 5 by the hinge 4, and provided with a T-shaped braking arm 6 at the other end thereof; a control unit 11 configured to have a microprocessor that performs control such that current is supplied to the first and second coil parts 3' and 3" in a predetermined pattern; and a power supply unit 13 configured to include a battery 12 mounted on the base plate 5 to supply power to the control unit 11, and an on/off switch (not shown).

The backward movement of the double-acting traveling device for moving toys is described below with reference to FIG. 5B, FIG. 5C and the second waveform diagram of FIG. 6.

When the control unit 11 directs current to be applied to the second coil part 3, the arm 7 is rotated around the hinge 4, for example, counterclockwise, and the braking arm 6 comes into contact with the left front wheel 9, as illustrated in FIG. 5B, thus preventing the left front wheel 9 from moving and, at the same time, the control unit 11 directs backward current (current flowing in the direction opposite to that of the current applied to the second coil part 3") to flow to the first coil part 3'.

When backward current flows to the first coil part 3', the rotating plate 15 is rotated around the hinge 4 clockwise, so that the rotating plate 15 is rotated clockwise while the left front wheel 9 is locked, and the right wheel 9 is pulled backward, as illustrated in FIG. 5C. By repeating the above-described operation for the right and left wheels 9, the base plate 5 can move backward in a zigzag fashion, like the forward movement of the base plate 5.

Meanwhile, when the pulse width of current having reverse pattern applied to the first coil part 3' is identical to that of current applied to the second coil part 3" (see the second waveform diagram of FIG. 3), the base plate 5 moves backward. When different pulse widths are employed (see the third waveform diagram of FIG. 3), the base plate 5 can rotate. Meanwhile, when current having the same pattern is applied to the first and second coil parts 3' and 3" (see the first waveform diagram of FIG. 3), the base plate 5 can move forward.

Although the preferred embodiments of the present invention have been described, the present invention is not limited to the embodiments, but various modifications and variations can be achieved within a range that does not depart from the spirit of the present invention.

For example, in FIG. 1 and FIG. 5A, during forward and backward movement and rotation, the front wheel 9 and the braking arm 6 come into contact with each other and the front wheel 9 is locked. In order to achieve more secure fixation, instead of contact between the front wheel 9 and the braking arm 6, it is possible to fit plastic gears around both sides of the traveling arm 10 near the front wheels 9 and form protrusions on the corresponding portions of both ends of the braking arm 6 one of which engages with one of the plastic gears when the front wheel 9 and the braking arm 6 come into contact with each other. As a result, at the time of contact, the protrusion of the braking arm 6 is engaged with the plastic gear of the traveling arm 10, more secure fixation can be achieved. Furthermore, instead of contact between the front wheel 9 and the braking arm 6, it is possible to fit rubber rings at the locations of the gears and allow each end of the braking arm 6 (having no protrusion) to come into contact with one of the rubber rings.

In FIG. 1 and FIG. 5A, the first and second magnets 1 and 2 are fixedly mounted on the base plate 5 and the third and fourth magnets 16 are 17 are fixedly mounted on the rotating plate 15, the coil part 3 is mounted on the arm 7 and the first and second coil parts 3' and 3" are respectively mounted on the rotating plate 15 and the arm 7, so that the coil part 3 is rotated relative to the base plate 5 and the first and second coil parts 3' and 3" are respectively rotated relative to the base plate 5 and the rotating plate 15.

However, the case where the same principle is employed but the locations of magnets and coils are opposite to those of the above-described embodiments can be provided. That is, it is possible to fixedly mount the coil part 3 on the base plate 5 in FIG. 1 and the first and second coil parts 3' and 3" on the base plate 5 and the rotating plate 15 in FIG. 5A, respectively, and mount the first and second magnets 1 and 2 on the arm 7 in FIG. 1, them on the rotating plate 15 in FIG. 5A, and the third and fourth magnets 16 and 17 on the arm 7 in FIG. 5A, so that the first and second magnets 1 and 2 are rotated relative to the base plate 5 and the third and fourth magnets 16 and 17 are rotated relative to the rotating plate 15.

In order to provide a simple structure while utilizing the same principle, the number of magnets can be reduced by half by employing a structure in which the arm 7 and the rotating plate 15 are spaced apart from each other to allow the first and second magnets to be arranged therebetween, the first and second magnets 1 and 2 are fixedly mounted on a structure secured onto the base plate 5, and the first and second coil parts 3' and 3" are respectively mounted on the rotating plate 15 below the first and second magnets 1 and 2 and mounted on the arm 7 above the first and second magnets 1 and 2, that is, a structure in which the second coil part 3" and the first coil part 3' are respectively located above and below the first and second magnets 1 and 2, instead of the structure in which the arm 7 and the rotating plate 15 overlap each other as in FIG. 5A.

Furthermore, the case where a principle identical to that of FIG. 5A is employed but a different method for reducing the number of magnets is used can be provided. That is, a structure in which the first coil part 3' is mounted on the base plate 5, the first and second magnets 1 and 2 are mounted on the rotating plate 15 above the first coil part 3', and the second coil part 3" is mounted on the arm 7 above the first and second magnets 1 and 2 can be provided.

Meanwhile, in the case where the driving of the moving toy is performed according to the waveforms of FIGS. 4 and 6, moving speed increases in proportion to the period of a driving signal. When the period is further shortened and a corresponding cycle reaches about 100 Hz, the mechanical structure of the traveling device does not follow such a short period at all and, thus, the traveling device stops, so that sound having a frequency corresponding to that of the driving signal is generated.

Using sound proportional to the frequency of such a driving signal, music can be played and an alarm sound can be generated without use of a speaker.

The above-described present invention is advantageous in that it is possible to manufacture a small-volume traveling device for moving toys that is capable of implementing forward and backward movement and rotation without using a motor or a reduction gear having large volumes.

Furthermore, since a moving toy having such a traveling device can be manufactured in a considerably small and low form, a key ring may be attached to the moving toy to allow the moving toy to be carried by a user or the moving toy may be used as a portable ornament, and the moving toy can be used as a moving toy immediately when power is applied thereto.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A traveling device for moving toys, comprising:

a base plate formed in a plate shape;

first and second magnets fixedly mounted on the base plate to be spaced apart from each other by a predetermined distance and configured to have opposite polarities on upper surfaces thereof;

a coil part mounted to be spaced apart from the first and second magnets, and formed of a wound coil, so that it generates magnetic force having a polarity that repels one of the first and second magnets when electricity is applied thereto;

an arm rotatably mounted on the base plate by a hinge, said arm having the coil part mounted at one end thereof and a braking arm at a remaining end thereof;

a traveling arm rotatably mounted on the base plate by the hinge, provided with front wheels at both ends thereof, and configured to come into contact with the braking arm when the braking arm is rotated through a predetermined angle;

a control unit configured to perform control such that current is supplied to the coil part in a predetermined pattern; and a power supply unit configured to supply power to the control unit.

2. A traveling device for moving toys, comprising:

a base plate formed in a plate shape;

first and second magnets fixedly mounted on the base plate to be spaced apart from each other by a predetermined distance and configured to have opposite polarities on upper surfaces thereof;

a first coil part mounted to be spaced apart from the first and second magnets, and formed of a wound coil, so that it generates magnetic force having a polarity that repels one of the first and second magnets when electricity is applied thereto;

a rotating plate rotatably mounted on the base plate by a hinge, said rotating plate having the coil part mounted at one end thereof and front wheels at a remaining end thereof;

third and fourth magnets fixedly mounted on the base plate to be spaced apart from each other by a predetermined distance and configured to have opposite polarities on upper surfaces thereof;

a second coil part mounted to be spaced apart from the third and fourth magnets, and formed of a wound coil, so that it generates magnetic force having a polarity that repels one of the third and fourth magnets when electricity is applied thereto;

an arm rotatably mounted on the base plate by the hinge, said arm having the second coil part mounted at one end thereof and a braking arm at a remaining end thereof, and configured to operate such that a front wheel side thereof comes into contact with the braking arm;

a control unit configured to perform control such that current is supplied to the first and second coil parts in a predetermined pattern; and a power supply unit configured to supply power to the control unit.

3. A traveling device for moving toys, comprising:

a base plate formed in a plate shape;

first and second magnets mounted to be spaced apart from each other by a predetermined distance and configured to have opposite polarities on upper surfaces thereof;

a coil part fixedly mounted on the base plate, mounted to be spaced apart from the first and second magnets, and formed of a wound coil, so that it generates magnetic force having a polarity that repels one of the first and second magnets when electricity is applied thereto;

an arm rotatably mounted on the base plate by a hinge, said arm having the first and second magnets at one end thereof and a braking arm at a remaining end thereof;

a traveling arm rotatably mounted on the base plate by the hinge, provided with front wheels at both ends thereof, and configured to come into contact with the braking arm when the braking arm is rotated through a predetermined angle;

a control unit configured to perform control such that current is supplied to the coil part in a predetermined pattern; and a power supply unit configured to supply power to the control unit.

4. A traveling device for moving toys, comprising:

a base plate formed in a plate shape;

first and second magnets fixedly mounted on a support structure, which is secured to the base plate at a bottom thereof, to be spaced apart from each other by a predetermined distance and configured to have opposite polarities on upper surfaces thereof;

a first coil part mounted to be spaced apart from the first and second magnets, and formed of a wound coil, so that it generates magnetic force having a polarity that repels one of the first and second magnets when electricity is applied thereto;

a rotating plate rotatably mounted on the base plate by a hinge, said rotating plate having the first coil part mounted at one end thereof and front wheels at a remaining end thereof;

a second coil part mounted to be spaced apart from the first and second magnets, and formed of a wound coil, so that it generates magnetic force having a polarity that repels one of the first and second magnets when electricity is applied thereto;

an arm rotatably mounted on the base plate by the hinge, spaced apart from the rotating plate to allow the first and second magnets to be arranged therebetween, said arm having the second coil part mounted at one end thereof and a braking arm at a remaining end thereof, and configured to operate such that a front wheel side thereof comes into contact with the braking arm;

a control unit configured to perform control such that current is supplied to the first and second coil parts in a predetermined pattern; and a power supply unit configured to supply power to the control unit.

5. A traveling device for moving toys, comprising:

a base plate formed in a plate shape;

first and second magnets mounted to be spaced apart from each other by a predetermined distance and configured to have opposite polarities on upper surfaces thereof;

a first coil part fixedly mounted on the base plate, and formed of a wound coil, so that it generates magnetic force having a polarity that repels one of the first and second magnets when electricity is applied thereto;

a rotating plate rotatably mounted on the base plate by a hinge, and provided with the first and second magnets at one end thereof and front wheels at a remaining end thereof;

a second coil part mounted to be spaced apart from the first and second magnets, and formed of a wound coil, so that it generates magnetic force having a polarity that repels one of the first and second magnets when electricity is applied thereto;

an arm rotatably mounted on the base plate by the hinge, said arm having the second coil part mounted at one end thereof and a braking arm at a remaining end thereof, and configured to operate such that a front wheel side thereof comes into contact with the braking arm;

a control unit configured to perform control such that current is supplied to the first and second coil parts in a predetermined pattern; and a power supply unit configured to supply power to the control unit.

6. The traveling device as set forth in claim 1 or 3, wherein the contact between the braking arm and the traveling arm is performed in such a way that the braking arm comes into contact with the front wheel.

7. The traveling device as set forth in any one of claims 2, 4 and 5, wherein the contact between the front wheel side of the rotating plate and the braking arm is performed in such a way that the braking arm comes into contact with the front wheel.

8. The traveling device as set forth in claim 1 or 3, wherein the contact between the braking arm and the traveling arm is performed in such a way that one of gears fitted around both sides of the traveling arm near the front wheels is engaged with one of protrusions formed on corresponding portions of both ends of the braking arm.

9. The traveling device as set forth in any one of claims 2, 4 and 5, wherein the contact between the front wheel side of the rotating plate and the braking arm is performed in such a way that one of gears fitted around both sides of the rotating plate near the front wheels is engaged with one of protrusions formed on corresponding portions of both ends of the braking arm.

10. The traveling device as set forth in claim 1 or 3, wherein the contact between the braking arm and the traveling arm is performed in such a way that one of rubber rings fitted around both sides of the traveling arm near the front wheels comes into contact with the braking arm.

11. The traveling device as set forth in any one of claims 2, 4 and 5, wherein the contact between the front wheel side of the rotating plate and the braking arm is performed in such a way that one of rubber rings fitted around both sides of the rotating plate near the front wheels comes into contact with the braking arm.

12. The traveling device as set forth in any one of claims 1 to 5, wherein the moving toy is a crawling insect toy.

13. The traveling device as set forth in claim 1 or 3, wherein the coil part is supplied with a driving signal having a frequency higher than a frequency that causes the traveling device to stop and generates sound.

14. The traveling device as set forth in any one of claims 2, 4 and 5, wherein the first and second coil parts are supplied with driving signals having frequencies higher than a frequency that causes the traveling device to stop and generates sound.

* * * * *